United States Patent [19]

Ishigaki et al.

[11] Patent Number: 4,769,063

[45] **Date of Patent: * Sep. 6, 1988**

[54] METHOD FOR PRODUCING RARE EARTH ALLOY

[75] Inventors: Naoyuki Ishigaki, Otsu; Takaki Hamada, Takatsuki; Setsuo Fujimura, Kyoto, all of Japan

[73] Assignee: Sumitomo Special Metals Co., Ltd., Osaka, Japan

[ * ] Notice: The portion of the term of this patent subsequent to Aug. 30, 2005 has been disclaimed.

[21] Appl. No.: 832,890

[22] Filed: Feb. 26, 1986

[51] Int. Cl.[4] ..... C22C 1/04

[52] U.S. Cl. ..... 75/0.5 BA; 148/302; 420/83; 420/121

[58] Field of Search ..... 75/0.5 BA; 148/301, 148/302, 331; 420/83, 121, 455, 581

[56] References Cited

U.S. PATENT DOCUMENTS

| | | | |
|---|---|---|---|
| 3,748,193 | 7/1973 | Cech | 148/301 |
| 3,826,696 | 7/1974 | Cech | 148/301 |
| 3,877,999 | 4/1975 | Lerman et al. | 148/301 |
| 3,878,000 | 4/1975 | McFarland et al. | 148/301 |
| 3,883,346 | 5/1975 | Martin | 75/0.5 BA |

FOREIGN PATENT DOCUMENTS

| | | | |
|---|---|---|---|
| 0101552 | 2/1984 | European Pat. Off. . | |
| 0106948 | 5/1984 | European Pat. Off. . | |
| 0134304 | 3/1985 | European Pat. Off. . | |
| 0134305 | 3/1985 | European Pat. Off. . | |
| 0184722 | 6/1986 | European Pat. Off. . | |
| 2039972 | 2/1971 | Fed. Rep. of Germany . | |
| 2303697 | 12/1973 | Fed. Rep. of Germany . | |
| 59-179703 | 10/1984 | Japan | 75/0.5 BA |
| 59-177346 | 10/1984 | Japan . | |
| 61-37341 | 8/1986 | Japan . | |

OTHER PUBLICATIONS

Chemical Abstracts, vol. 104, No. 20, May 19, 1986, p. 266, Abstract No. 172787u, Columbus, Ohio, U.S.

Chemical Abstracts, vol. 102, No. 15, Apr. 22, 1985, p. 248, Abstract No. 135934c, Columbus, Ohio, U.S.

Chemical Abstracts, vol. 99, No. 2, Jul. 11, 1983, p. 220, Abstract No. 9440v, Columbus, Ohio, U.S.

*Primary Examiner*—John P. Sheehan

*Attorney, Agent, or Firm*—Wegner & Bretschneider

[57] ABSTRACT

A rare earth alloy for producing permanent magnet comprised of: 15–65 atomic % $R_1$, 35–83 atomic % Fe, and 0–15 atomic % B, where $R_1$ represents at least one of heavy rare earth elements Gd, Tb, Dy, Ho, Er, Tm and Yb. This alloy is produced by reducing a mixture of correspoding rare earth oxides, Fe, and a boron containing material by Ca, contacting the reduced mass with water, and treating the resultant slurry with water. Using this alloy, Fe-B-R base magnets wherein $R_1$ is substituted for part of R (R representing lanthanide and/or Y) having a high performance are produced with a reduced cost.

5 Claims, No Drawings

METHOD FOR PRODUCING RARE EARTH ALLOY

FIELD OF THE INVENTION

The present invention relates to Fe-B-R base rate earth magnet materials having a high-performance, particularly, method for producing the same, wherein R represents at least one of Nd, Pr, La, Ce, Tb, Dy, Ho, Er, Eu, Sm, Gd, Pm, Tm, Yb, Lu, and Y.

BACKGROUND OF THE INVENTION

The Fe-B-R base magnets have attracted public attention as a novel permanent magnet with a high-performance using rare earth elements (R) represented by Nd, Pr etc. They have prominent advantages that they exhibit the characteristics comparable to those of a conventional high-performace magnet, e.g., the Sm-Co base magnet, do not require expensive and scarce Sm as R and do not necessarily use expensive Co which is difficult to be procured steadily, as disclosed in JP Patent Kokai No. 59-46008 or EP No. 0101552. Particularly, Nd has been hitherto regarded as having no utility value. Therefore, it is very valuable for industry that Nd can be used as a principal element.

Recently, it has been attempted to provide high magnetic characteristics for the Fe-B-R base magnets and to produce them at lower costs. For example, the applicants' company developed a high-performance magnet using, as R, Nd and/or Pr mainly, and partly at least one of Gd, Tb, Dy, Ho, Er, Tm and Yb (hereinafter, these elements are referred to as $R_1$), and filed a patent application thereon (JP Application No. 58-140590, now JP Pat. Kokai No. 60-32306 or EP 0134305). In the JP Pat. Kokai No. 60-32306, it was proposed that the superior $R_1$-$R_2$-Fe-B base rare earth magnets (wherein $R_1$ represents the same as hereinabove mentioned, and $R_2$ represents that the sum of Nd and/or Pr is at least 80 atomic % and the balance in $R_2$ is at least one of rare earth elements R other than $R_1$) are produced by substituting at least one of heavy rare earth elements $R_1$ for at most 5 atomic % of rare earth element such as Nd, Pr, etc. in the R-Fe-B base or R-Fe-Co-B base rare earth magnets. These superior $R_1$-$R_2$-Fe-B base rare earth magnets enable to prominently raise the coercive force (iHc) to 10 kOe or more and to be used at 100°-150° C., i.e., temperatures higher than room temperature, while maintaining a high energy product of (BH) max of at least 20 MGOe. As starting materials for the production of $R_1$-$R_2$-Fe-B base rare earth magnets, primarily there are used expensive bulk or lump metals having little impurities, such as electrolytic iron with a purity of at least 99.9%, and rare earth metals with a purity of at least 99.5% prepared by an electrolysis or a heat reduction.

SUMMARY OF THE DISCLOSURE

Therefore, any of these raw materials is the high quality material having little impurities previously refined from ores. Using these materials, the resultant magnets become considerably expensive in spite of the efforts for lowering the cost by using of Nd, Pr, etc. The content of the heavy rare earth metals $R_1$ such as Gd, Tb, Dy, Ho, Er, Tm, Yb, etc. which are effective for increasing the coercive force, is at most 7% in the ore, that is, less than the content of Nd which is 15%. Actually, such heavy rare earth metals are expensive, since their production requires high separating-refining technics and their production efficiency is low. Consequently, $R_1$-$R_2$-Fe-B base permanent magnets having a high-performance and a high iHc are very valuable as the practical permanent magnet materials, but have a drawback in their high cost.

It is a primary object of the present invention to provide higher magnetic characteristics for the Fe-B-R base magnets and to enable the inexpensive production.

More specifically, the prsent invention relates to a heavy rare earth alloy (or powder thereof) for magnet raw materials for use in the high-performance rare earth magnets of $R_1$-$R_2$-Fe-B base ($R_1$ represents at least one of rare earth elements including Gd, Tb, Dy, Ho, Er, Tm and Yb, and $R_2$ represents that the sum of Nd and/or Pr is at least 80 atomic % and the balance in $R_2$ is at least one of rare earth elements including Y other than $R_1$) and to a method for producing them.

Thus a further object of the present invention is to provide an $R_1$ base rare earth alloy with a reduced cost in an industrial scale. That is, a concrete object of the present invention is to eliminate the various drawbacks above-mentioned and to inexpensively provide a high-quality rare earth alloy containing the $R_1$-element in a mass-production scale.

In an aspect, the present invention relates to a rare earth alloy characterized in an alloy consisting essentially of $R_1$: 15–65 atomic %,
Fe: 35–83 atomic %, and
B: 0–15 atomic %, in which $R_1$ represents at least one of Gd, Tb, Dy, Ho, Er, Tm and Yb, with an oxygen content being at most 7000 ppm, and a carbon content being at most 1000 ppm.

In another aspect, the present invention relates to a method for producing a rare earth alloy having said alloy composition with an oxygen content being at most 7000 ppm, and a carbon content being at most 1000 ppm, characterized in steps of:

preparing a mixed raw material powder comprising at least one of the oxides of rare earth elements $R_1$, an iron powder and a boron containing powder selected from the group consisting of boron, ferroboron, boron oxide, and alloys or mixed oxides of the componental elements in a manner such that the resultant alloy product consists essentially of:
15–65 atomic % $R_1$,
35–83 atomic % Fe, and
0–15 atomic % B,
in which $R_1$ represents at least one of heavy rare earth elements selected from the group consisting of Gd, Tb, Dy, Ho, Er, Tm and Yb; said mixed raw material powder further comprising metallic Ca and/or Ca hydride in an amount of 1.2–3.5 times by weight of the amount stoichiometrically required for reducing oxygen in said raw material powder and at least one of the oxides of said rare earth elements $R_1$, and 1–15 % by weight of calcium chloride based on the oxides of said rare earth elements $R_1$;

subjecting the resultant mixture to reduction-diffusion treatment under a nonoxidizing atmosphere at a temperature of 950°–1200° C.;

contacting the resultant reduced mass with water to form a slurry-like substance; and treating said slurry-like substance with water to recover the resultant alloy powder;

whereby said alloy powder has an oxygen content of at most 7000 ppm, and a carbon content of at most 1000 ppm.

For both aspects, said $R_1$ is preferably 15–50 atomic %, and B is preferably 2–15 atomic %.

In a further embodiment, said mixed raw material powder is prepared so that said alloy product consists essentially of:

25–40 atomic % $R_1$,

50–71 atomic % Fe, and

4–10 atomic % B.

The reduction-diffusion treatment provides direct reduction of oxides in the starting materials.

The reduced mass is preferably brought to a particle size from 8 mesh to 35 mesh prior to contacting with water. The contacting with water may be effected by bringing the reduced mass (for crushed or pulverized mass) in water. The reduction-diffusion treatment may be effected after compacting the resultant mixture, however, the compacting may be eliminated. As the heavy rare earth elements $R_1$ use of Ho, Tb and/or Dy is preferred, while most preferred is Dy. Tm and Yb might encounter some difficulty in procurement in a large amount and cost. Within this preferred range the alloy product may include R-Fe-B tetragonal crystal structure expressed by the formula $R_2Fe_{14}B$ in an amount of, e.g., at least 50 vol %, more preferably at least 80 vol % of the entire alloy.

DETAILED DESCRIPTION OF THE PREFERRED EMBODIMENTS

In the following the preferred embodiments of the present invention will be described in detail.

By using the $R_1$-Fe-B alloy powder of the present invention, it is possible to provide the inexpensive $R_1$-$R_2$-Fe-B base rare earth magnets which are used in a sufficiently stable state at temperatures higher than room temperature maintaining magnetic characteristics having a (BH) max of at least 20 MGOe and iHc of at least 10 kOe. The inexpensive heavy rare earth metal oxide as one of the starting materials used in the present invention includes $Ho_2O_3$, $Tb_3O_4$ and the like, which are present as the intermediates in the prestep for the preparation of rare earth metals. Since the rare earth alloy of the present invention is produced by using as starting materials such inexpensive heavy rare earth metal oxide, Fe-powder and at least one of pure boron powder, Fe-B powder and boron-containing powder (e.g., $B_2O_3$), by using as reducing material a metallic calcium powder and by using calcium chloride for easy collapse or disintegration of reduction-diffusion-reaction product, an inexpensive, improved alloy powder containing $R_1$ as the raw materials of $R_1$ for the $R_1$-$R_2$-Fe-B base magnets may be obtained easily in an industrial scale. Therefore, the method of the present invention is much superior in efficiency and economical effect, as compared with the conventional method using the produced $R_1$-rare earth metal of the bulk form.

Hereupon, if the mixed powder of the $R_1$-rare earth metal oxide and metal powders such as Fe-powder, Fe-B powder, etc. as the starting materials is subjected to reduction-diffusion-reaction by metallic Ca, the rare earth metal in molten state at the reaction temperature in situ forms an alloy very easily and uniformly, together with Fe-powder or Fe-B powder. In this case, the $R_1$-rare earth alloy powder is recovered in a high yield from the $R_1$-rare earth metal oxide, and hence the $R_1$-rare earth metal oxide may be utilized effectively.

The B (boron) content in the raw material powder serves to effectively drop the reaction temperature at the reduction-diffusion-reaction of the $R_1$-Fe-B alloy powder, and facilitates the reduction-diffusion-reaction of the alloy based on the present invention. Therefore, in order to produce $R_1$-heavy rare earth raw materials for the $R_1$-$R_2$-Fe-B base magnets in an industrial scale from the inexpensive heavy rare earth metal oxide, the inventors considered as most effective to produce the alloy powder from the heavy rare earth metal oxide, Fe which constitutes the main ingredient of the magnets and is produced inexpensively in a mass-production system, and B.

From such points of view, the inventors have come to find the $R_1$-Fe-B base alloy in a specific composition-range of the present invention and the method for producing them. Moreover, the rare earth alloy of the present invention has been developed for the purpose of producing the alloy for the above $R_1$-$R_2$-Fe-B base permanent magnet. However, the powder of the present invention is not limited to this purpose, and is applicable not only for the production of a wide range of Fe-B-R base magnets, but also for the production of various raw materials using Fe-B-R as a constituent ingredient.

The rare earth alloy of the present invention may be produced by the following steps, and are usable to the alloys for the $R_1$-$R_2$-Fe-B base permanent magnets. The mixed raw material powder of at least one of various heavy rare earth metal oxides such as Ho oxide ($Ho_2O_3$), Tb oxide ($Tb_4O_7$), etc. and an iron powder, and at least one of pure boron powder, ferroboron (Fe-B) powder and boron trioxide ($B_2O_3$) powder is prepared in order to form the alloy product consisting essentially of:

$R_1$: 15–65 atomic %,

Fe: 35–83 atomic %, and

B: 0–15 atomic % in which $R_1$ represents one of heavy rare earth elements including Gd, Tb, Dy, Ho, Er, Tm and Yb. To the mixed raw material powder are added metallic calcium and/or calcium hydride as a reducing agent of the heavy rare earth metal oxide and $CaCl_2$-powder for promoting the collapse of the reaction product (briquette) after the reduction, consequently obtaining the incorpoated materials. The amount of calcium (metallic or as hydride) required is 1.2–3.5 times (by weight) as much as the amount stoichiometrically required for the reduction of oxygen content of the mixed raw material powder. The amount of $CaCl_2$ is 1–15% by weight, based on the rare earth metal oxide raw materials. Mixing of all the materials may be done at once or sequentially.

The above mixed materials including each raw material powder such as heavy rare earth metal oxide powder, Fe-powder, ferroboron powder, Ca as a reducing agent and the like, is (occasionally compacted and) subjected to reduction-diffusion treatment under the atmosphere of an inert gas (e.g., argon) for 1 to 5 hours preferably at a temperature ranging 950° to 1200° C., more preferably 950° to 1100° C., and then is cooled to room temperature to result in a reduction-reaction product. This reaction product is usually pulverized to a particle size of at most 8 mesh (at most 2.4 mm), and is brought into water, in which calcium oxide (CaO), $CaO.2CaCl_2$ and excess Ca in the reaction product are converted into calcium hydroxide [$Ca(OH)_2$] etc. while the reaction product itself collapses to form a slurry mixed with water. From this slurry, the Ca contained is throughly removed with water, consequently obtaining a rare earth alloy powder having a particle size of 5 μm–1 mm according to the present invention. Considering the workability in a magnet production step and the magnetic characteristics, the particle size of the powder of the present invention is preferably 20 μm–1 mm, more preferably 20 μm–500 μm. At a temperature below 950° C. the reduction-diffution reaction becomes insufficient, while above 1200° C. wear of furnace becomes serious.

When the reduction-reaction product is brought into water without pulverization to a particle size of at most 8 mesh, that is, as such or as a particle size of more than 8 mesh, it might become occasionally unsuitable for the industrial production due to slow collapse and reaches a high temperature due to the accumulated destruction-reaction heat in its product if blocks are too large, so that the obtained rare earth alloy powder might have an oxygen content of more than 7000 ppm and hence become unsuitable for use in the subsequent magnet-production step. If the reduction-reaction product has a particle size of less than 35 mesh, it starts to burn due to vigorous reaction. Preferably, water used in the present invention is ion-exchanged water or distilled water, considering the little oxygen content in the alloy powder, high yield in the magnet-producing step and good magnetic characteristics.

Thus obtained alloy powder for the magnetic materials consists essentially of the following composition:
$R_1$: 15–65 atomic % (preferably 15–50 atomic %),
Fe: 35–83 atomic %, and
B: 0–15 atomic % (preferably 2–15 atomic %),
in which $R_1$ represents at least one of heavy rare earth elements including Gd, Tb, Dy, Ho, Er, Tm and Yb, with an oxygen content being at most 7000 ppm, and a carbon content being at most 1000 ppm. Using this alloy powder, the $R_1$-$R_2$-Fe-B base permanent magnet may be produced, as described hereafter.

More preferred composition range of the rare earth alloy powder of the present invention is as follows:
$R_1$: 25–40 atomic %,
Fe: 50–71 atomic %, and
B: 4–10 atomic %.

In this composition, the oxygen content of the alloy powder comes to at most 4000 ppm, and the carbon content thereof comes to at most 600 ppm. This facilitates formation of the alloy, causes less generation of slag, increases yield of the alloy product and makes the effective use of the alloy powder possible, in the course of melt-alloying of the $R_1$-$R_2$-Fe-B magnetic alloy. If the alloy powder as such is used by being added in the pulverization step, the amounts of the oxides and the carbides are reduced in the permanent magnet, so that the $R_1$-$R_2$-Fe-B permanent magnet achieves a high coercive force and excellent magnetic characteristics. Further, the reducing temperature becomes 950°–1100° C., which facilitates the production in an industrial scale. The rare earth alloy powder of the present invention can be used either by adding a required amount of the alloy powder of the present invention as a compact or sintered mass upon melt-alloying the $R_1$-$R_2$-Fe-B magnetic alloy, or by adding a required amount of the alloy powder of the present invention as such to a separately prepared $R_2$-Fe-B alloy powder in the pulverization-step to obtain the mixed $R_1$-$R_2$-Fe-B alloy powder. In any case, the method of the present invention has advantages that it shortens the process for the production of the magnets and lowers the costs of the produced magnet due to the use of inexpensive raw materials. Further, it has advantageous economical effects since it facilitates the mass-production of practical permanent magnets.

The oxygen in the alloy powder of the present invention is combined with the rare earth element to be most easily oxidized to form rare earth metal oxide. Therefore, if the oxygen content is more than 7000 ppm, the melting of the alloy in the melting-step of the $R_1$-$R_2$-Fe-B magnetic alloy becomes difficult, which does not form an alloy, causes a considerable generation of slag, lowers the yield of the alloy product and hence prevents the effective use of the alloy powder based on the present invention.

If the carbon content is more than 1000 ppm, carbides are left in the final permanent magnet product, which leads to an undesirable decrease of magnetic characteristics, particularly a decrease of the coercive force below 10 kOe and deteriorates the loop squareness of the demagnetization curve of the magnet.

If the oxygen content is more than 7000 ppm and the carbon content is more than 1000 ppm in the case where the alloy powder as such is used by adding in the pulverization-step, both ingredients are left as oxides and carbides ($R_3C$, $R_2C_3$, $RC_2$) in the resultant permanent magnet, which lowers the coercive force remarkably.

If the Ca content as the reducing agent of the raw materials of the present invention exceeds 3.5 times as much as the amount required stoichiometrically, vigorous chemical reaction occurs in the reduction-diffusion-reaction, which causes prominent heat generation and brings about serious wear of a reaction vessel by the highly reductive Ca, and hence makes the steady mass-production impossible. Further, in this case, the residual Ca content in the alloy powder produced in the reduction-step becomes high, which wears out the furnace in the heat-treating-step of magnet production due to generation of much Ca vapor and deteriorates the magnetic characteristics due to the high Ca content in the magnet product. If the Ca content is less than 1.2 times as much as that required stoichiometrically, the reduction-diffusion-reaction is incomplete and non-reduced substances are left in a large amount, so that the alloy powder of the present invention is not obtained. The amount of Ca is preferably 1.5–2.5 times, most preferably 1.6–2.0 times of the stoichiometric amount.

If the amount of $CaCl_2$ exceeds 15% (by weight), the $Cl^-$(Chlorine ion) in water increases remarkably in the treatment of the reduction-diffusion-reaction product with water, and reacts with the produced rare earth alloy powder, so that the oxygen content of the powder attains more than 7000 ppm, and the powder can not be utilized as raw materials for the $R_1$-$R_2$-Fe-B magnets. Besides, in case of less than 1 weight % of $CaCl_2$, the collapse does not occur even if the reduction-diffusion-reaction product is put into water, thus its treatment by water becomes impossible.

The reasons for limiting the range of the composition of the rare earth alloy powder of the present invention are as follows. Where the $R_1$ element (at least one of Gd, Tb, Dy, Ho, Er, Tm and Yb), which is indispensable for improving the coercive force (iHc) of the $R_1$-$R_2$-Fe-B base rare earth magnets, is less than 15 atomic %, the residual Fe content increases and the oxygen content in the alloy powder attains more than 7000 ppm, the melting of the $R_1$-$R_2$-Fe-B base magnetic alloy in the melt production becomes difficult, which does not form the alloy, causes slag formation, and lowers the yield of the melt-formed alloy.

If the $R_1$ element is more than 65 atomic %, the amount of the rare metal oxide in the raw materials for the reduction is too large to be reduced sufficiently or to form the rare earth metal oxide adequately. In this case, the oxygen content of the alloy powder is more than 7000 ppm, which brings about, as is the case with the previous case, the difficult alloy formation and the drop in the alloy yield. Thus the $R_1$ element of no more than 50 atomic % is preferred.

Fe is an indispensable element for directly obtaining the rare earth alloy of the present invention, which is inexpensive and of good quality, by the process wherein the $R_1$ rare earth element obtained by the reduction of the heavy rare earth metal oxide with metallic calcium diffuses immediately. In the case of less than 35 atomic % or more than 83 atomic % of the Fe content, the oxygen content of the alloy powder becomes more than 7000 ppm, and the carbon content thereof becomes more than 1000 ppm, so that the production of a superior magnet from the alloy becomes difficult, the yield of the melt-produced alloy decreases and the alloy powder is unable to be used for the magnetic alloys.

B (boron) is preferred element for lowering the reduction-diffusion temperature of the alloy based on the present invention. B is effective at 0.1 atomic % or more. In the case of less than 2 atomic % of B content, the reduction temperature of more than 1200° C. is occasionally required, and the utilization of the equipment of an industrial scale becomes difficult since the extremely high reductive Ca is used. Further, in the case of more than 15 atomic % of the B content, the oxygen content of the rare earth alloy powder obtained reaches more than 7000 ppm since boron is subjected to oxidation easily, so that, as the previous case, the magnet production from the alloy becomes difficult, the yield of the melt-formed alloy decreases and the alloy powder is not effective as the alloy powder for magnetic materials.

As mentioned previously, the alloy product of the present invention includes ones having an Fe-B-R tetragonal crystal structure within the preferred alloy composition, while the presence of such crystal structure is not essential for the entire compositional scope of the present invention. However, even the alloy product having no FeBR tetragonal crystal structure may be utilized to prepare the $FeBR_1R_2$ alloy having the said crystal structure. Generally the directly reduced alloy product of the present invention is of the crystalline nature (e.g., crystal grain size of 20–120 μm).

In order to produce a $FeBR_1R_2$ sintered magnet a mixture (or preferably an alloy thereof) of said alloy product and appropriate $FeBR_2$ alloy (e.g., FeBNd) is prepared and pulverized to preferably 1–20 μm in size, then compacted and sintered, usually followed by aging. For preparing the $FeBR_1R_2$ alloy, said $FeBR_1$ alloy product is preferably consolidated by compacting, melting and/or sintering, or hot pressing or the like manner, then melted together with the $FeBR_2$ alloy. This consolidation provides easy alloying by high frequency melting. The resultant permanent magnet is generally of the FeBR tetragonal crystal structure (i.e., at least 80 vol % of the entire magnet), the crystal grain being preferably 1–40 μm (most preferably 3–20 μm) for excellent permanent magnet properties. The detailed disclosure about the FeBR tetragonal crystal structure is disclosed in EP 0101552 and herewith referred to.

It should be noted that the inventive alloy product may be utilized in producing $FeCoBR_1R_2$ type permanent magnet (refer to EP No. 0134304) wherein Co is present to be substituted for a part of Fe in the $FeBR_1R_2$ type magnet.

Furthermore, the alloy powder of the present invention may contain at most 2 % by weight of impurities inevitable in the technically available raw materials or in the manufacturing steps, for examples, Al, Si, P, Ca, Mg, Cu, S, Nb, Ni, Ta, V, Mo, Mn, W, Cr, Hf, Ti, Co etc., however the impurities should be as less as possible, e.g., at most 1 % by weight, or even at most 0.5 % by weight. Cu, S and P are particularly not preferred.

When the calcium content exceeds 2000 ppm, a large amount of strongly reducing Ca vapor is generated in the intermediate sintering step of the subsequent steps for making magnets from the alloy powders of the present invention. The Ca vapor contaminates the heat-treatment furnace used to a considerable extent and, in some cases, give rise to serious damage to the wall thereof, such that it becomes impossible to effect the industrially stable production of magnets. In addition, if the amount of Ca contained in the alloy powders formed by reduction is so large that a large amount of Ca vapor is generated at the time of heat treatment involved in the subsequent steps for making magnets to give damage to the heat treatment furnace used. This also leads to a large amount of Ca remaining in the resulting magnets, entailing deteriorations in the magnet properties thereof as a result. Thus a calcium content of 2000 ppm or less is preferred, most preferred is 1000 ppm or less.

Usually, the amount of rare earth elements in the rare earth metal oxides as the starting materials is calculated in considering the yield, and may be, e.g., 1.1 times of the amount in the alloy product.

EXAMPLES

Various rare earth alloy powders will now be described in detail with reference to the following examples.

EXAMPLE 1

$Tb_4O_7$ powder: 75.2 g
Fe powder: 35.1 g
Ferroboron powder (19.5 wt % B-Fe alloy powder): 2.2 g
Metallic Ca: 72.4 g (2.5 times as much as the amount required stoichiometrically)
$CaCl_2$: 3.8 g (5.1 wt % based on the rare earth metal oxide materials).

188.7 g of all the raw materials above-described were mixed in a V-type mixer, aiming at an alloy composed of 35% Tb - 61% Fe - 4% B (atomic %) (61.72 wt % Tb - 37.80 wt % Fe - 0.48 wt % B). Then, compacts of the mixed raw materials were charged in a stainless steel vessel, then placed in a muffle furnace, and heated in argon gas flow. After having been held constant at 1075° C. for 3 hours, the furnace was cooled to room temperature. The resultant reductive reaction product was pulverized to a particle size of 8 mesh-through, then was introduced into an ion-exchanged water, in which calcium oxide (CaO), $CaO.2CaCl_2$ and unreacted residual calcium were converted into calcium hydroxide allowing the reaction products to collapse to form a slurry-like product. After stirring for 1 hour, the product was allowed to stand for 30 minutes, and then the suspension of calcium hydroxide was removed. The product was again diluted with water. The Steps of stirring, standing and suspension-removing were repeated many times. Thus separated and withdrawn Tb-Fe-B base alloy powder was dried under vacuum. In this manner, there were obtained 76 g of the heavy rare earth alloy powder for the magnet raw materials of a 20–300 μm particle size according to the present invention.

The elementary analysis values of this powder were as follows:

Tb: 60.11 wt %
Fe: 39.45 wt %
B: 0.37 wt %
Ca: 0.08 wt %
$O_2$: 1900 ppm
C: 250 ppm.

As a result, the desired alloy powder was obtained.

A sintered body was prepared by treating the above alloy powder at 1150° C. for 2 hours in order to prepare a magnetic alloy composed of 14 Nd - 1.5 Tb - 77.5 Fe - 7 B (atomic %). This sintered body as the raw material of Tb was melted with the beforehand prepared metallic Nd, ferroboron alloy and Fe material. The resultant melt-formed alloy piece was pulverized to a powder having an average particle size of 2.70 μm, then was compacted in a magnetic field of 10 kOe under a pressure of 1.5 t/cm$^2$, thereafter was sintered at 1120° C. for 2 hours, and was aged at 600° C. for 1 hour to produce a permanent magnet specimen.

The obtained magnet specimen exhibited excellent magnetic characteristics as follows:

Br=11.5 kG
iHc=19 kOe
(BH)max=31.3 MGOe.

EXAMPLE 2

$Tb_4O_7$: 22.9 g
$Dy_2O_3$: 5.9 g
$Ho_2O_3$: 16.3 g
Fe powder: 42.6 g
Ferroboron powder (20.4 wt % B-Fe alloy powder): 8.0 g
Metallic Ca: 26.6 g (1.5 times as much as the amount required stoichiometrically)
$CaCl_2$: 2.7 g (5.9 wt % base on the rare earth metal oxide materials).

122.3 g of all the raw materials above-described were treated in the same manner as in Example 1 except that this example aimed at obtaining an alloy composition of 8% Tb - 5% Ho - 2% Dy - 73% Fe - 12% B (atomic %) (19.18% Tb - 12.44% Ho 4.90% Dy - 61.51% Fe - 1.96% B, by weight %). There was obtained 86 g of an alloy powder having a 50–500 μm particle size.

The elementary analysis values of this powder were as follows:

Tb: 19.74 wt %
Dy: 4.23 wt %
Fe: 60.73 wt %
Ho: 13.28 wt %
B: 1.86 wt %
Ca: 0.16 wt %
$O_2$: 5500 ppm
C: 750 ppm.

As a result, the required alloy powder was obtained.

A compact was prepared by compacting the above alloy powder under a pressure of 2 t/cm$^2$ for preparing a magnetic alloy composed of 14 Nd - 0.2 Tb - 0.15 Ho - 0.05 Dy - 78.6 Fe - 7 B (atomic %). The compact as the raw material of Tb-Ho-Dy was melted with metallic Nd, ferroboron alloy and Fe material. The resultant melt-produced alloy piece was pulverized to a powder having an average particle size of 2.67 μm, then was compacted in a magnetic field of 10 kOe under a pressure of 1.5 t/cm$^2$, thereafter was sintered at 1120° C. for 2 hours and was aged at 600° C. for 1 hour to produce a permanent magnet.

The obtained magnet exhibited excellent magnetic characteristics as follows:

Br=12.4 kG
iHc=11.5 kOe
(BH)max=35.8 MGOe.

EXAMPLE 3

Mixed heavy rare earth metal oxides : 91.4 g

The composition of the mixed heavy rare earth metal oxides is as follows:

$Dy_2O_3$: 80 wt %
$Tb_4O_7$: 10 wt %
$Ho_2O_3$: 3 wt %
$Er_2O_3$: <0.5 wt %
$Tm_2O_3$: <0.5 wt %
$Gd_2O_3$: 6 wt %
$Yb_2O_3$: <0.5 wt %
Fe powder: 22.1 g
Ferroboron powder (20.0 wt % B-Fe alloy powder): 1.8 g
Metallic Ca: 97.3 g (3.3 times as much as the amount required stoichiometrically)
$CaCl_2$: 11.0 g (12.0 wt % based on the rare earth metal oxide materials)

223.6 g of all the raw materials above-described were treated in the same manner as in Example 1 except that this example aimed at obtaining an alloy composition of 50% $R_1$ - 46% Fe - 4% B (atomic %)(75.7 wt % $R_1$- 23.9 wt % Fe - 0.4 wt % B). There was obtained 73 g alloy powder having a 10–650 μm particle size.

The elementary analysis values of this powder were as follows:

Dy: 65.9 wt %,
Gd: 4.6 wt %,
Er: 0.2 wt %,
Yb: 0.1 wt %,
B: 0.35 wt %,
$O_2$: 3300 ppm,
Tb: 4.0 wt %,
Ho: 1.2 wt %,
Tm: 0.2 wt %,
Fe: 23.4 wt %,
Ca: 0.05 wt %,
C: 650 ppm.

As a result, the required alloy powder was obtained.

This alloy powder having a particle size of at most 500 μm (−35 mesh) and the Nd-Fe-B alloy powder beforehand prepared to a particle size of at most - 35 mesh after its melting were mixed, aimed at the production of an alloy composed of 14 Nd - 1.5 $R_1$ - 77.5 Fe - 7 B (atomic %). The mixed powder was pulverized by means of a ball mill for 3.5 hours to produce a fine powder having an average particle size of 2.75 μm.

A permanent magnet specimen was produced from this fine powder in the manner as in Example 1.

The obtained magnet specimen exhibited excellent magnetic characteristics as follows:

Br=11.4 kG
iHc=17.50 kOe (BH)max=30.9 MGOe.

It should be understood that the present invention is not limited to the specific embodiments and modification is allowed without departing from the gist and scope of the present invention as disclosed and claimed.

What is claimed is:

1. A method for producing a rare earth alloy which comprises:

preparing a mixed raw material powder comprising at least one of the oxides of rare earth elements R1, an iron powder and a boron containing powder selected from the group consisting of boron, ferroboron and boron oxide in a manner such that the resultant alloy product consists essentially of:

15–65 atomic % $R_1$,

35–83 atomic % Fe, and

0–15 atomic % B, in which $R_1$ represents at least one of heavy rare earth elements selected from the group consisting of Gd, Tb, Dy, Ho, Er, Tm and Yb; said mixed raw material powder further comprising metallic Ca and/or Ca hydride in an amount of 1.2–3.5 times by weight of the amount stoichiometrically required for reducing oxygen in said raw material powder and at least one of the oxides of said rare earth elements $R_1$, and 1–15 % by weight of calcium chloride based on the oxides of said rare earth elements $R_1$;

compacting the resultant mixture;

subjecting the resultant compacted mixture to reduction-diffusion treatment under a nonoxidizing atmosphere at a temperature of 950°–1200° C.;

bringing the reduced mass to a particle size of 8 mesh to 35 mesh;

contacting the resultant reduced mass with water to form a slurry-like substance; and treating said slurry-like substance with water by stirring the slurry and removing water to recover the resultant alloy powder;

whereby said alloy powder has an oxygen content of at most 7000 ppm, and a carbon content of at most 1000 ppm.

2. The method according to claim 1, in which said mixed raw material powder is prepared so that said alloy product consists essentially of:

25–40 atomic % $R_1$,

50–71 atomic % Fe, and

4–10 atomic % B.

3. The method according to claim 1, wherein the treating with water is effected until the amount of Ca becomes no more than 2000 ppm in the resultant alloy powder.

4. The method according to claim 1, wherein the reduction-diffusion treatment is effected at a temperature ranging from 950° to 1100° C.

5. The method according to claim 1, wherein the method further comprises consolidation of the resultant alloy powder.

* * * * *

UNITED STATES PATENT AND TRADEMARK OFFICE

CERTIFICATE OF CORRECTION

PATENT NO. : 4,769,063
DATED : September 6, 1988
INVENTOR(S) : Ishigaki et al.

It is certified that error appears in the above-identified patent and that said Letters Patent is hereby corrected as shown below:

Title page,
Item [*], Notice should read -- The portion of the term of this patent subsequent to November 25, 2005 has been disclaimed. --.

Signed and Sealed this

Twenty-fourth Day of June, 2003

JAMES E. ROGAN
*Director of the United States Patent and Trademark Office*